US007815260B2

(12) United States Patent
Mathiez

(10) Patent No.: US 7,815,260 B2
(45) Date of Patent: Oct. 19, 2010

(54) METHOD OF CUTTING BRISTLES OF A COSMETIC APPLICATOR BRUSH

(75) Inventor: Jean-Louis Mathiez, Limours (FR)

(73) Assignee: Coty S.A.S., Paris (FR)

( * ) Notice: Subject to any disclaimer, the term of this patent is extended or adjusted under 35 U.S.C. 154(b) by 0 days.

(21) Appl. No.: 11/675,485

(22) Filed: Feb. 15, 2007

(65) Prior Publication Data

US 2008/0023018 A1 Jan. 31, 2008

Related U.S. Application Data

(60) Division of application No. 10/925,868, filed on Aug. 25, 2004, now Pat. No. 7,201,454, which is a continuation of application No. PCT/EP03/02000, filed on Feb. 13, 2003.

(30) Foreign Application Priority Data

Feb. 25, 2002 (FR) ..... 02 02381

(51) Int. Cl.
*A46D 1/06* (2006.01)

(52) U.S. Cl. ..... 300/21; 300/2; 300/17

(58) Field of Classification Search ..... 300/2, 300/17, 21; 15/206; 132/218
See application file for complete search history.

(56) References Cited

U.S. PATENT DOCUMENTS

| | | | | |
|---|---|---|---|---|
| 1,693,263 | A | 11/1928 | Veen et al. | |
| 3,095,240 | A | 6/1963 | Theodore | |
| 4,586,520 | A * | 5/1986 | Brittain | 132/218 |
| 5,020,551 | A | 6/1991 | Guerret | |
| 5,472,263 | A * | 12/1995 | Gerspacher | 300/17 |
| 6,289,902 | B1 * | 9/2001 | Mathiez | 132/218 |
| 6,651,675 | B2 | 11/2003 | Mathiez | |
| 2005/0081874 | A1 | 4/2005 | Mathiez | |

FOREIGN PATENT DOCUMENTS

| | | |
|---|---|---|
| DE | 4141372 | * 6/1993 |
| EP | 925741 | * 12/1998 |
| FR | 2793121 | 5/1999 |

* cited by examiner

*Primary Examiner*—Mark Spisich
(74) *Attorney, Agent, or Firm*—Schwegman, Lundberg & Woessner, P.A.

(57) ABSTRACT

In order to apply mascara and comb they eyelashes, the invention proposes carrying out a selective, clean and adaptable cutting of the bristles twisted along a core by selecting some of the bristles located, along the wire, in angular sectors of adjustable amplitude and by continuously cutting the bristles thus selected at a predetermined height. The implementing guiding module has a guiding inlet head (69*a*) and a cylindrical tube body (69*c*), the head being for bristles remain curved. The cutting (70) and guiding (45) groove formed by an end piece with a conical outline extended by a hollow tube having a central channel (31) of the same diameter, cutting (70) and guiding (45) grooves being formed in the channel. The cutting grooves (70) are distributed longitudinally in order to select the brush bristles to be left untouched, alternating with the grooves (45) for guiding brush bristles to be protected from being cut, the cutting grooves (70) forming, in the tube body, cutting slots (57) and guiding grooves (45) having a depth such that the selected grooves from indentations (45*a*, 74*a*) on the end of the end piece. The present invention is mainly applicable to the cosmetic industry.

13 Claims, 10 Drawing Sheets

METHOD OF CUTTING BRISTLES OF A COSMETIC APPLICATOR BRUSH

RELATED APPLICATIONS

Figure 2A:
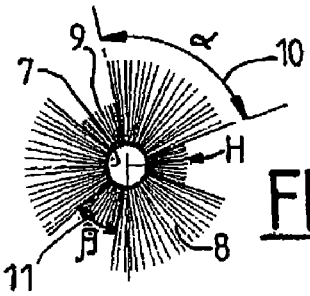

This application is a divisional application of U.S. patent application Ser. No. 10/925,868, filed Aug. 25, 2004, now U.S. Pat. No. 7,201,454, which application is a continuation under 35 U.S.C. 111(a) of International Application No. PCT/EP03/02000 filed Feb. 13, 2003 and published in English as WO 03/070051 A1 on Aug. 28, 2003, which claimed priority from French Patent Application No. 0202381 filed Feb. 25, 2002, which applications and publication are incorporated herein by reference.

The present invention mainly relates to a method for cutting a brush intended for the application of a product for cosmetic use, in particular a pasty product such as mascara to be applied to the eyelashes or eyebrows; it also relates to the guide tube and to the cutting machine for implementing the method, and to the brush cut according to said method and to the applicator system having such a brush, the stem on which it is mounted, and the wiper on which it is wiped.

In general, mascara is packaged in a bottle whose opening is restricted by a wiper, and the brush is mounted at the end of a stem secured to a cap screwed onto the bottle.

In the storage condition, the brush is immersed in the pasty formula of the product and is therefore loaded, that is to say the interstices between the bristles are filled with the paste.

The amount of paste present on the brush is controlled, on coming out of the bottle, by the wiper whose wiping lip, located around its orifice, scrapes off any excess. This orifice is generally circular, with a diameter close to the diameter of the stem and less than the diameter of the brush.

The applicator system has a dual function: to apply the paste and to comb the eyelashes or eyebrows. The control of the amount of paste is determining for the performance of the application system: too small an amount on the brush will not apply enough paste to the eyelashes, giving an insubstantial and inefficient makeup, while too high an amount will not allow the eyelashes and eyebrows to be correctly combed and separated. In the latter case, the makeup will be coarse and inaccurate.

For a given paste formula, it is known from the prior art that the proper amount of paste will be determined by a combination of appropriate diameters for the stem, the brush and the orifice of the wiper. The diameter of the stem is matched to the diameter of the wiper, so as to allow sliding with zero or moderate friction, while preventing the heavy loading of the stem which would be caused by an excessive clearance.

A small-diameter brush passes easily through the orifice of the wiper and keeps a high load of paste since only the ends are of the bristles are wiped. However, such a solution is not efficient for combing.

In contrast, a large-diameter brush, that is to say having long bristles, carries too little product after wiping, since the bristles, which are bent back sharply when passing through the orifice, lose a large part of their load.

In addition to the respective dimensioning of the elements of the applicator system, the nature of the fibers used for the brush, and their cross section, their rigidity, their number, etc., are also to be taken into account depending on the texture and the viscosity of the formula in order to improve the performance.

Since the number of parameters linked together is high, designing a wiping system generally leads to a situation of compromise between the various desired qualities: thick coating (volume), separation of the eyelashes (combing), lengthening effect, curving effect, etc.

This comprise is especially difficult to achieve because some parameters change over time:

- the viscosity of the paste changes with temperature;
- the gradual evaporation of the water or solvents contained in the paste also changes its viscosity and its texture;
- the aging of the brush fibers, while immersed in the paste, tends to increase their diameter by impregnation, thereby decreasing their rigidity.

A known method for increasing the performance of an application system consists in using bristles of different lengths on the same brush: the short bristles and the presence of interstices between these bristles make it possible to store the product to be applied to the user's eyelashes, and the long bristles make it possible to properly comb and efficiently separate the eyelashes.

To produce these two types of bristles for the same brush, document U.S. Pat. No. 4,586,520 provides alternating rows formed from long and short bristles, respectively. However, the envelope diameter of the short bristles is substantially greater than the diameter of the stem and of the wiper. They are therefore also wiped when passing through the wiper and then no longer contain enough material during the application.

Document U.S. Pat. No. 5,595,198 describes bristle sizes having lengths graduated within a given range. Such a distribution of bristle lengths does not allow the two distinct functions mentioned above for use on applicators to be carried out correctly.

Document U.S. Pat. No. 6,279,583 describes methods consisting in twisting the wire in two phases, before and after a sizing operation, so as to mix the short bristles with the long bristles. This method is relatively expensive, and does not allow the two distinct functions mentioned above to be carried out correctly, since the short bristles dispersed between the long bristles are curved by the bending of the latter on passing through the orifice of the wiper.

Thus, none of these documents describe a cutting method. Furthermore, none of the existing cutting methods makes it possible to obtain bristles as short as desired. This is because the known methods use a back plate cutting tool of the "trimmer" type, and the back plate entails a distance between the cutting element and the metal core of the brush at least equal to its thickness. Furthermore, a safe distance between the blade and the metal core is needed so as not to damage the cutting tool.

The invention aims to alleviate the drawbacks mentioned above by making it possible to apply a large amount of mascara in a single application, in order to give volume to the eyelashes, and to comb, separate and curve the eyelashes. It is also an aim of the present invention to provide a mascara brush at a moderate cost price.

To achieve these aims, the invention proposes carrying out a selective and clean cut of the bristles by masking some bristles which are not to be cut.

More specifically, the subject of the invention is a method of cutting bristles of an applicator brush for a cosmetic product consisting, based on a brush having a twisted core in which are trapped bristles whose envelope is an axisymmetric surface about the core, produced according to a commonly used method, in separating the bristles of the brush into angular sectors along the core, the bristles intended to be cut are brought together in a line in first cutting sectors, while the bristles of second sectors complementary to the first are folded substantially parallel to the core in order to be left untouched, and in then carrying out an operation of cutting the aligned bristles. After this operation, the folded bristles are released and stand up again due to their own elasticity, in order to form rows of long bristles along the core of the brush.

According to particular embodiments:

- the bristles are separated by prior selection of the bristles to be cut and of the bristles to be left untouched into the corresponding sectors;
- the cutting is carried out over several cutting sectors, either simultaneously or sector by sector.

The invention also relates to a hollow module for guiding brush bristles into which the brush is inserted, comprising a head for selecting the bristles to be cut and to be left untouched, extended along the same axis by a tubular element with longitudinal slots in order to expose the ends of bristles to be cut. The external dimension of the tubular element determines the cutting length.

The selection head has an inlet orifice having a diameter less than the envelope diameter of the brush and of the longitudinal cutting grooves which select the bristles intended to be cut. The grooves may be radial through grooves in order to form slots, or else remain blind.

The tubular element has a central channel with a diameter less than the envelope diameter of the brush and slots continuing on from the cutting grooves. The tubular element has a thickness which determines the length of the bristles emerging from the slots and intended to be cut by at least one cutting tool. This associated cutting tool, which may be a grinding wheel or a milling cutter, with a blade or disk, bears on the tubular element or in the immediate proximity. The cut bristles are advantageously collected by means of a suction device. The cutting tool makes it possible to chop the bristles emerging from the slots corresponding to the cutting of at least one angular cutting sector. The cutting tool may also be a laser beam, a high pressure water jet, an ultrasound device or the equivalent.

According to particular embodiments:

- the longitudinal cutting grooves are formed along the entire length of the guiding module from the orifice of the selection head;
- complementary guiding grooves, intended to guide the folded bristles, are formed longitudinally between the cutting grooves along the entire length of the module from the orifice of the selection head;
- the cutting and guiding grooves are formed in the selection head with a depth such that the selected bristles remain folded down, and the cutting grooves are distributed regularly alternating with the grooves for guiding brush bristles to be left untouched;
- the cutting slots are arranged along the axis of the tubular element or along a helical path with a pitch having a length at least five to ten times greater than the pitch of the twisted core of the brush, the angular distribution of the slots depending on the overall size of the cutting tools;
- the tubular element has notches around the cutting slots in order to cut as closely as possible to the core;
- the tubular element has a conicity of up to 10 to 15° on the outer face having the slots in order to vary the length to which the bristles are cut depending on the axial position of the cutting tool bearing on this face;
- the selection head has an inner frustoconical mouthpiece intended to make it easier to insert the brush by producing a funnel effect;
- the selection head has an outer frustoconical end, the intersection between the cutting grooves and the frustoconical end forming notches improving the selection;
- the slots or the cutting grooves have, around the frustoconical mouthpiece, an opening which flares out to the end of the head, it being possible for this width to be adjusted by bending the guiding slots by exerting a radial pressure on the end piece, especially by an adjustment ring, in particular one which is conical or has a variable diameter; such an adjustment varies the opening of the cutting grooves on the selection head and therefore the angle of the sectors of cut bristles.

Advantageously, the brush is self-centering in the guiding module because of the statistically even distribution of the bristles around the core of the brush, which therefore positions itself automatically on the axis of the guiding module.

The invention also relates to a cutting machine equipped with such a module, bristle cutting means associated with the cutting slots, motor means for rotating the tube and/or the cutting tools, at a speed of up to 30 000 rpm, preferably between 5 and 20 000 rpm, it being possible for the tube to be mounted on support bearings, and loading and centering means and means for rotating the in-going brushes before they are inserted into the cutting tube.

According to particular embodiments, flat or annular cutting means, especially in the form of a straight or circular blade, are placed around the tube and associated with the cutting slots.

The invention also relates a brush cut according to the method above, and to the applicator system comprising such a brush, a stem for supporting a cylindrical brush, having a diameter of between 3 and 5 mm, and a wiper made of a flexible thermoplastic, elastomer or thermoplastic elastomer material, provided with an orifice having a diameter of between 2 and 6 mm.

According to a preferred embodiment, the brush of the applicator system comprises longitudinal rows of bristles of different lengths, the bristles of at least one of these rows having a length such that the bristle ends are inscribed within the envelope profile of the stem, itself substantially equal to the profile of the opening of the wiper, by adjustment to higher or lower values.

The invention also relates to the cosmetic product having such an applicator system associated with a corresponding cosmetic formula.

Figure 2B:
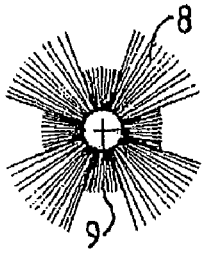
Figure 2C:
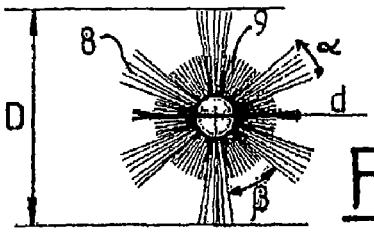
Figure 1:
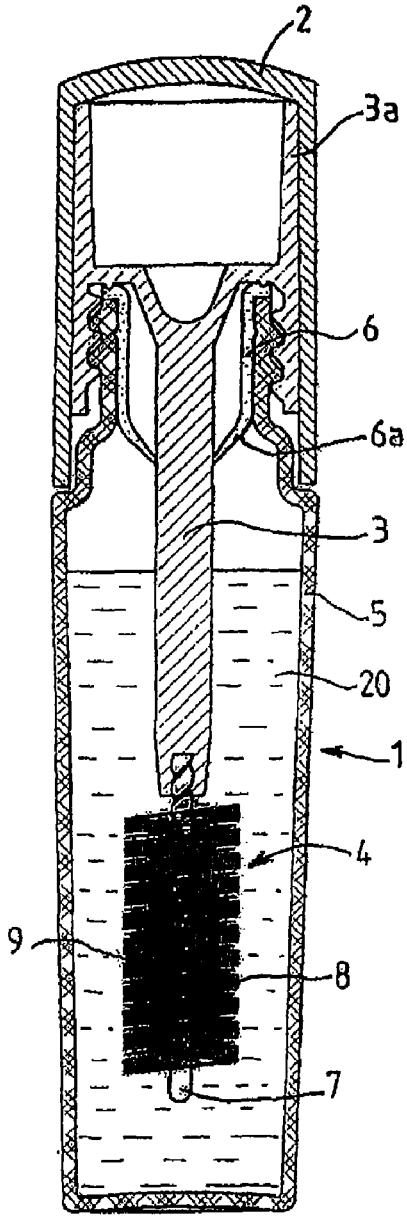
Figure 3A:
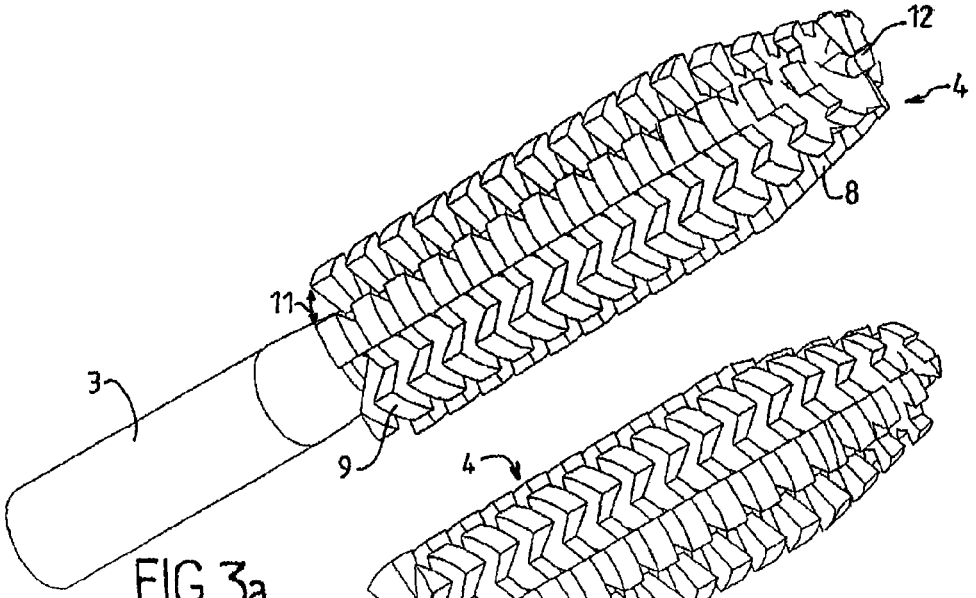
Figure 3B:
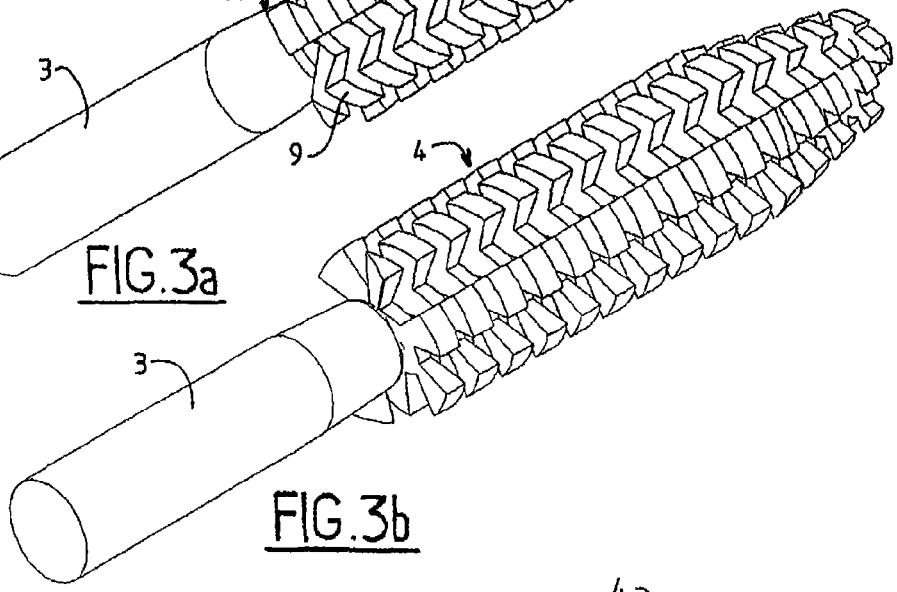
Figure 3C:
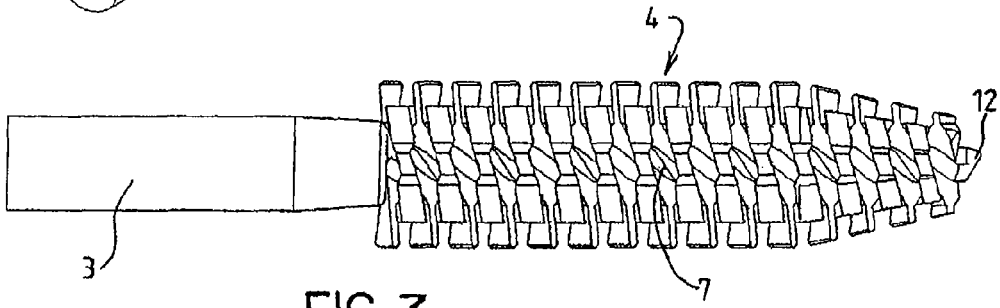
Figure 4:
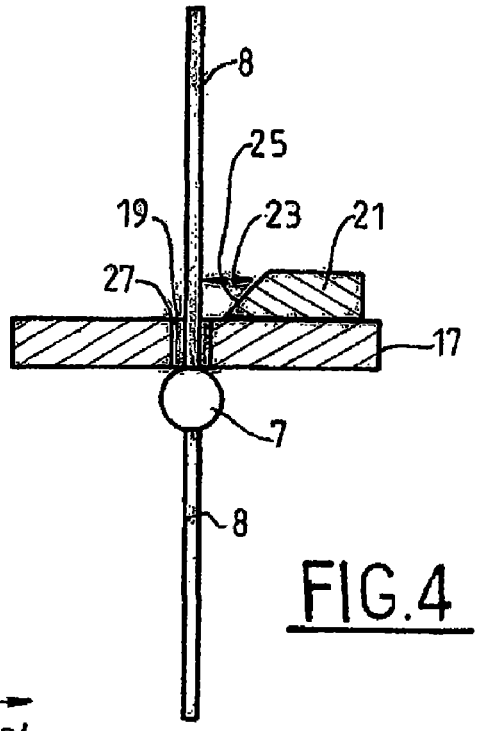
Figure 5:
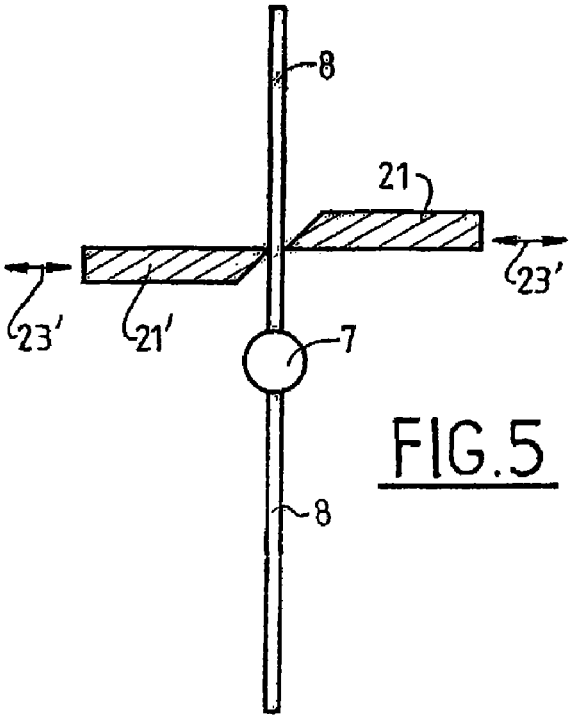
Figure 6:
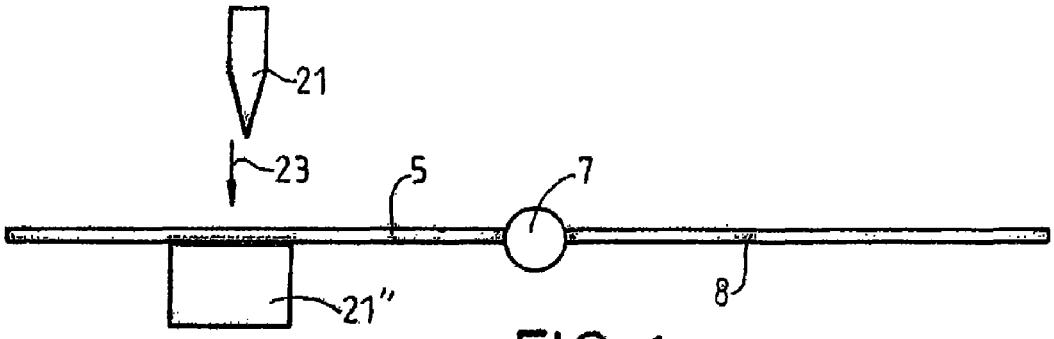
Figure 7:
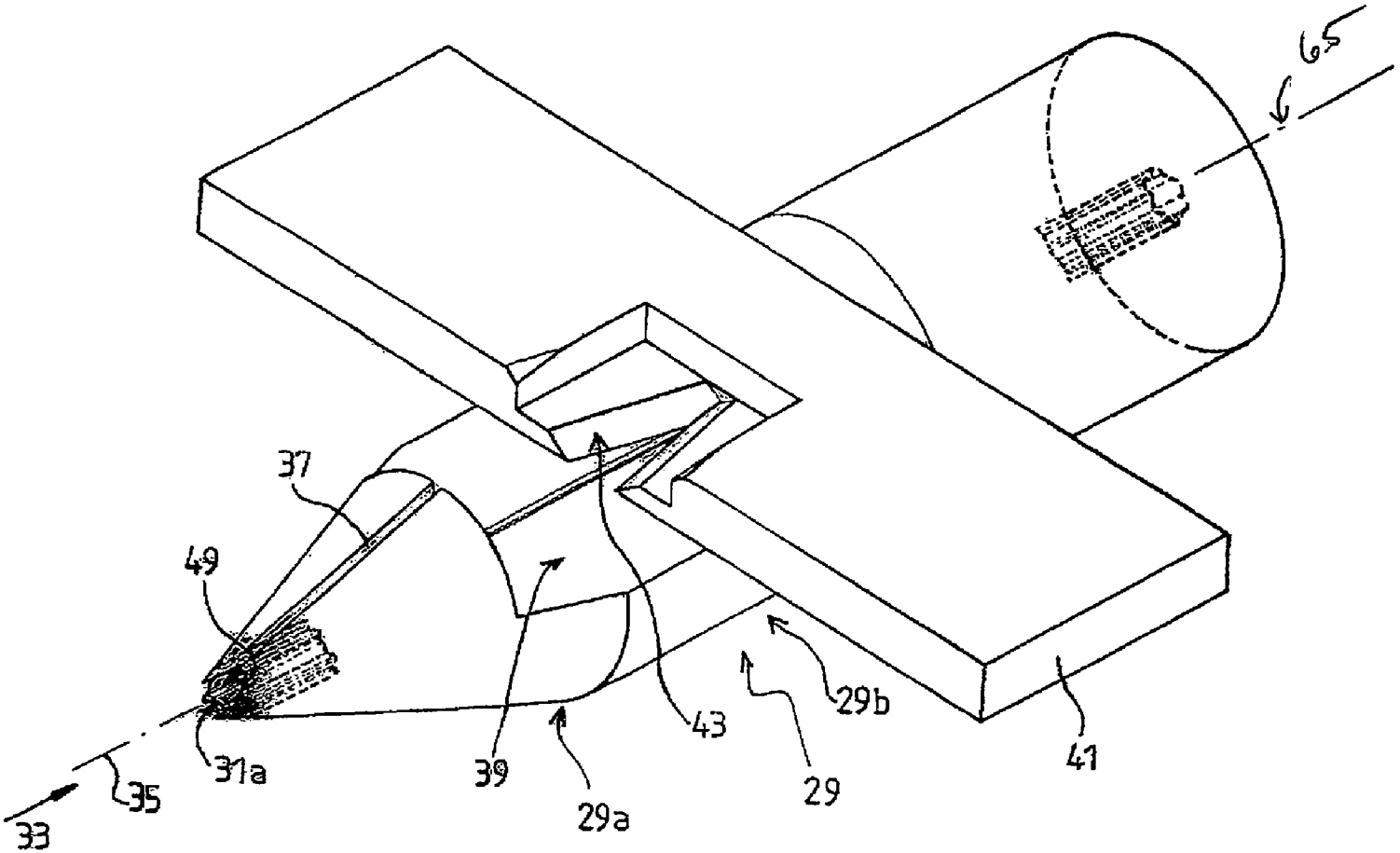
Figure 8:
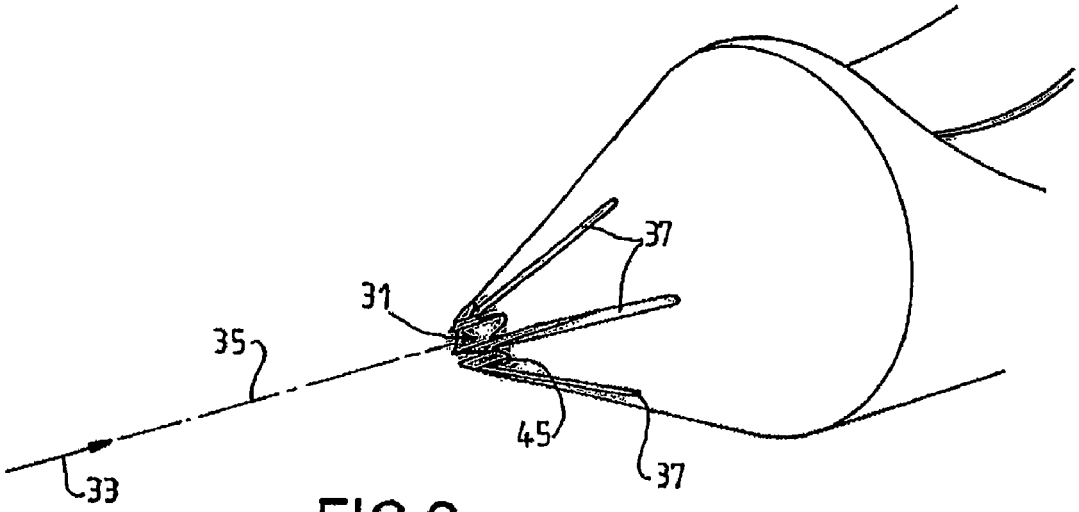
Figure 9:
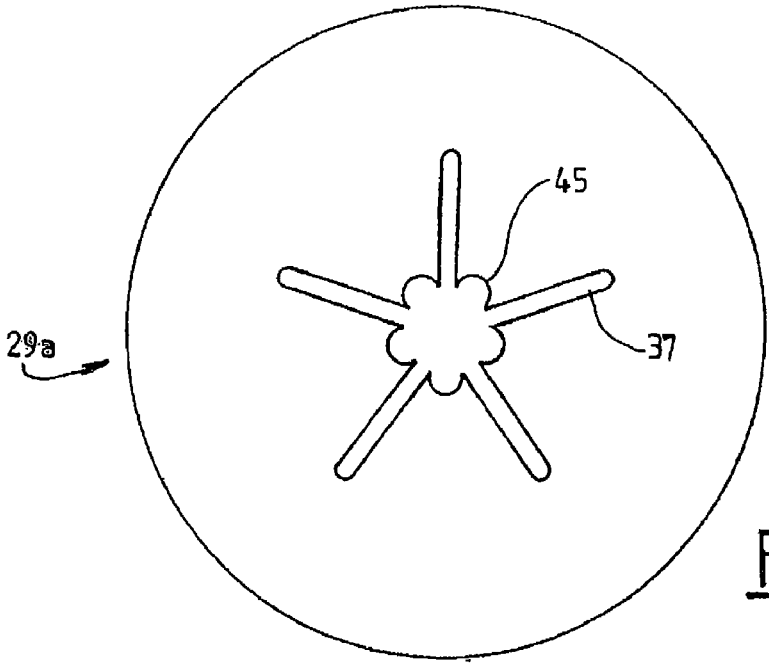
Figure 10:
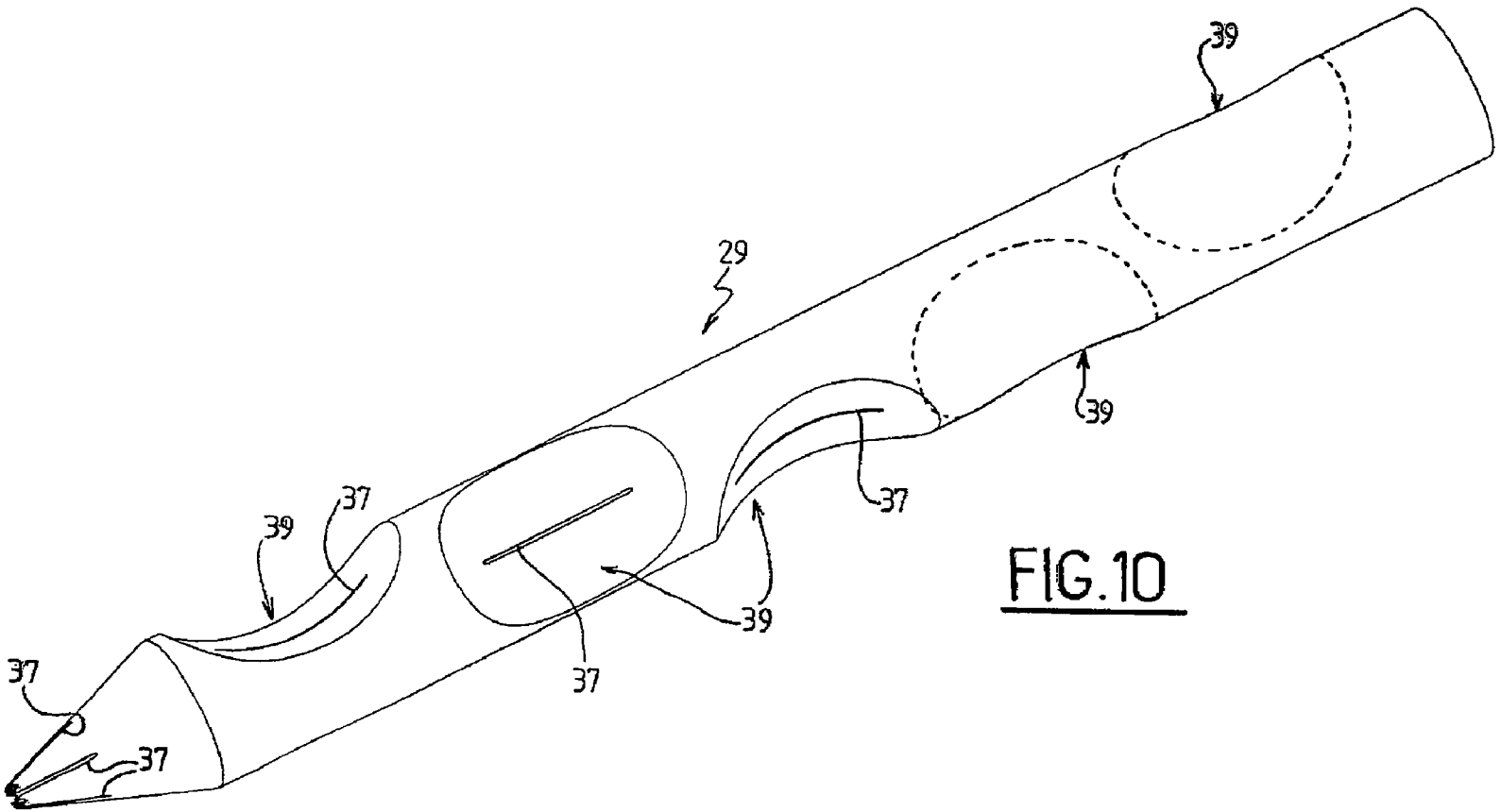
Figures 11, 12:
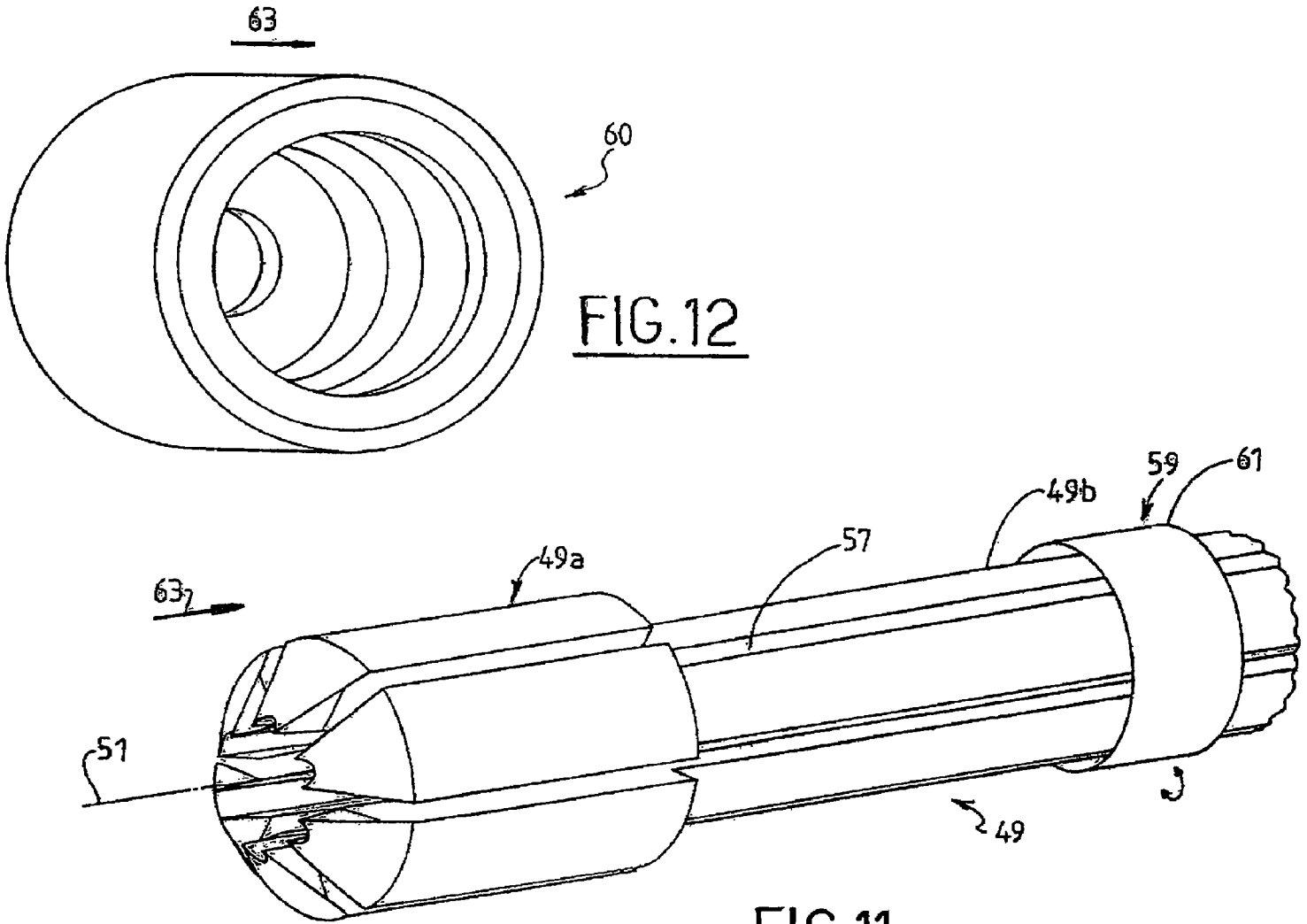
Figure 13A:
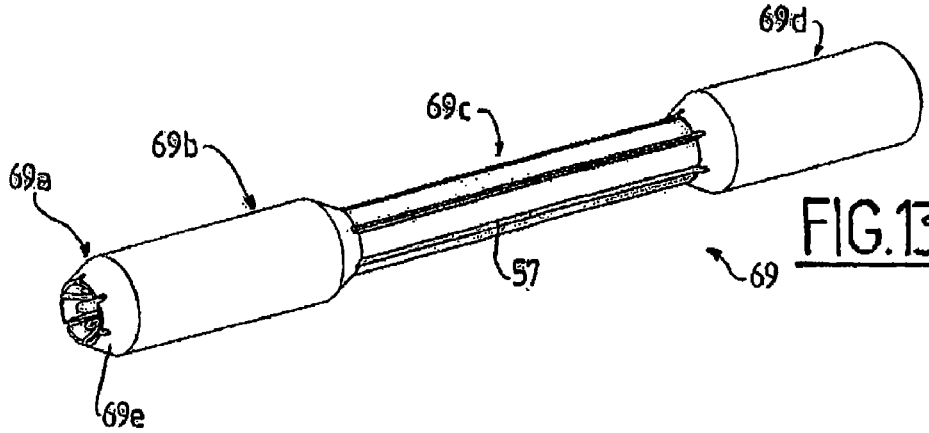
Figure 13B:
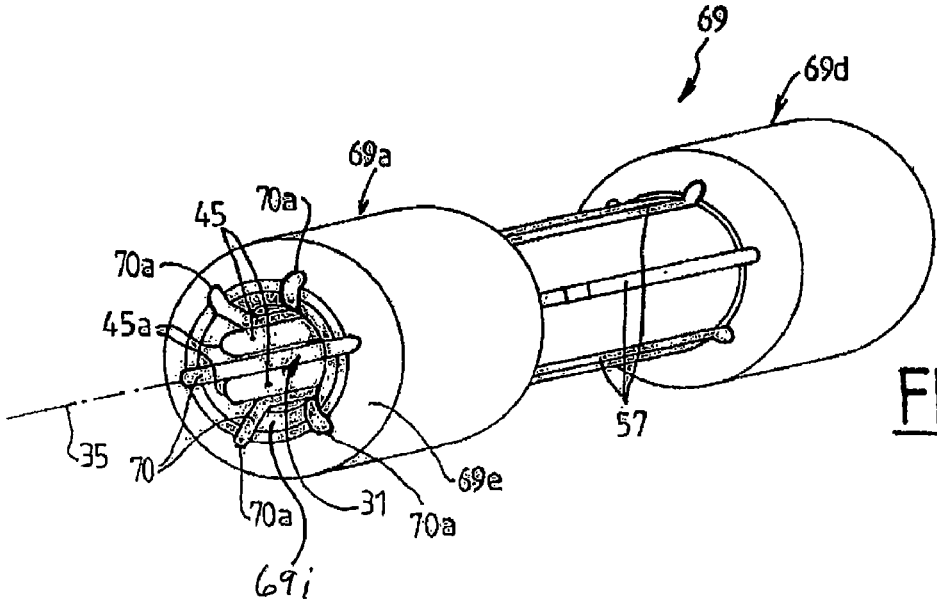
Figure 13C:
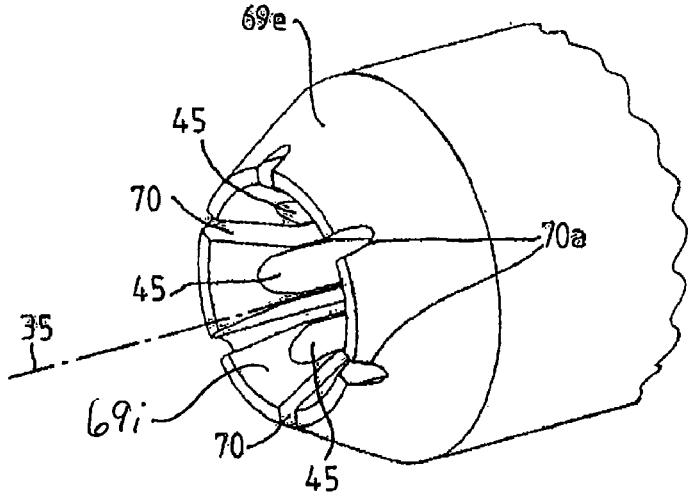
Figure 14A:
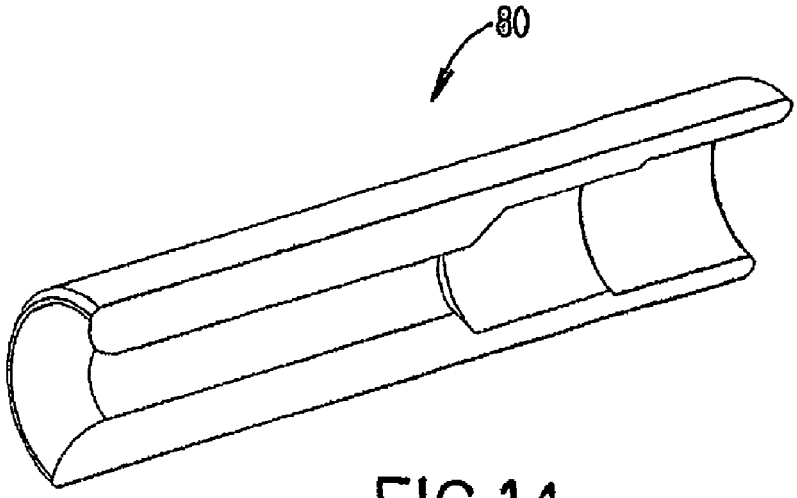
Figure 14B:
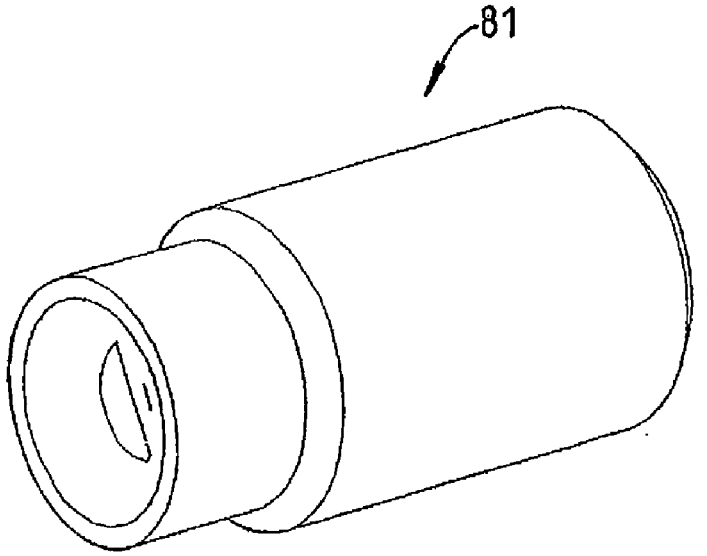
Figure 15A:
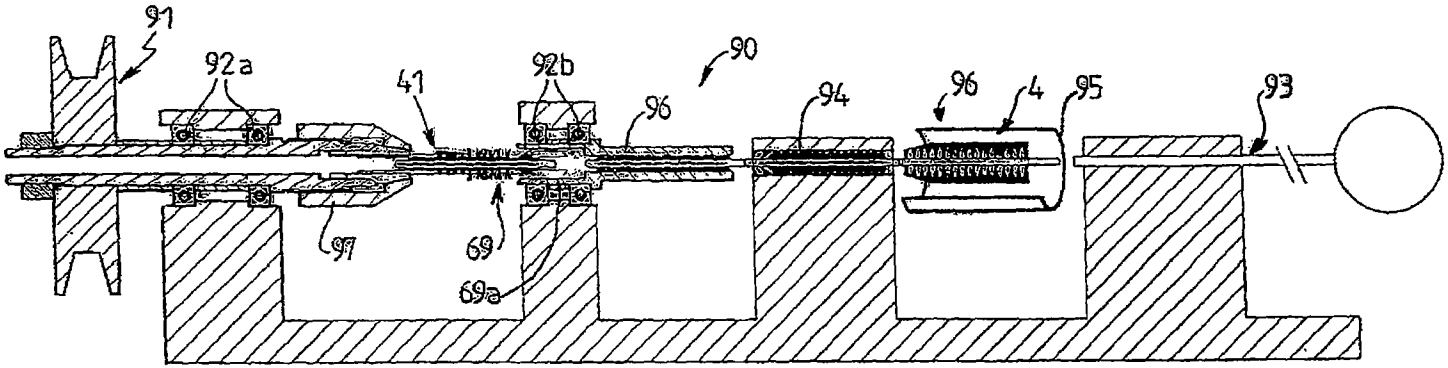
Figure 15B:
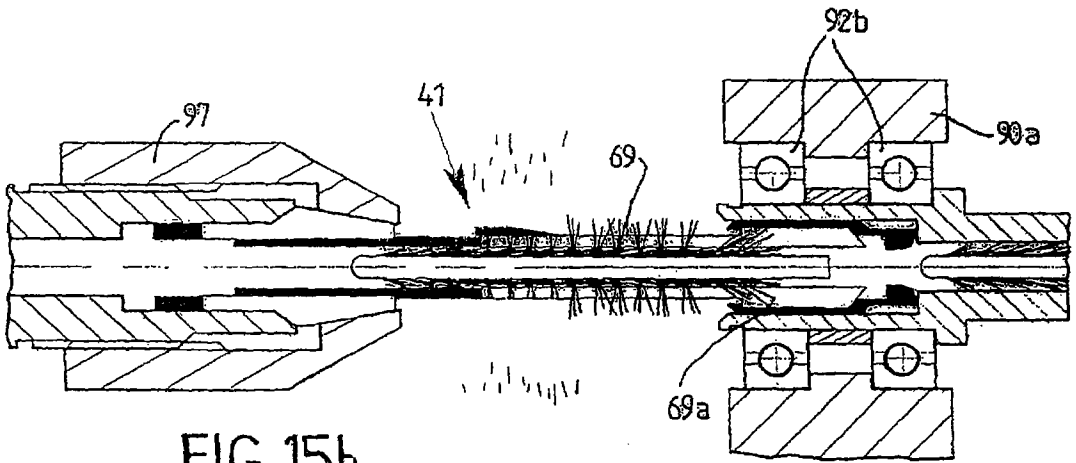

Other features and advantages of the invention will become apparent on reading the description below and the appended figures, given as nonlimiting examples, and which show respectively:

FIG. 1, a general sectional view of a packaging for applying mascara equipped with an applicator system according to the prior art;

FIGS. 2*a* to 2*c*, schematic end views of brushes cut by the method according to the present invention;

FIGS. 3*a* to 3*c*, front and rear isometric views and lateral sections of an exemplary brush according to the invention;

FIG. 4, a view in schematic cross section illustrating a first exemplary bristle-cutting method according to the present invention;

FIG. 5, a view in schematic cross section illustrating a second exemplary bristle-cutting method according to the present invention;

FIG. 6, a view in schematic cross section illustrating a third exemplary bristle-cutting method according to the present invention;

FIG. 7, a partial perspective view of a first embodiment of a cutting guide tube associated with a flat cutting blade;

FIG. 8, a perspective view of the head of the guide tube according to FIG. 7;

FIG. 9, an end view of the head of the guide tube according to FIG. 7;

FIG. 10, a complete isometric view of the guide tube according to FIG. 7;

FIG. 11, a perspective view of an exemplary guide tube with continuous and adjacent slots;

FIG. 12, a perspective view of an annular ring for clamping the guide head according to FIG. 9;

FIGS. 13*a* to 13*c*, perspective views of the second embodiment of the cutting tube according to the present invention;

FIGS. 14*a* and 14*b*, sectional and side views of two annular rings for clamping the guide head according to FIGS. 13*a* to 13*c*; and FIGS. 15*a* and 15*b*, a sectional view with partial enlargement of a cutting machine according to the present invention.

In all the figures, identical reference signs denote identical or similar elements.

As is apparent in the sectional view of FIG. 1, a mascara applicator system 1 conventionally consists of a cap 2, on which a head 3*a* of the stem 3, coupled at its end to a mascara brush 4, is mounted securely, the cap and the stem being screwed onto an element in the shape of a tubular body 5 containing the mascara. The neck of this tube 5 is internally equipped with a wiper 6 fitted with a circular lip 6*a* which presses against the stem 3. The wiper is made from a flexible thermoplastic, from LDPE (low-density polyethylene) or from an elastomer, for example of the TPE (thermoplastic elastomer) type or neoprene type.

According to a common method, the mascara brush 4 is produced from a metal wire 7 forming the linear central core of the brush. Fibers, for example made of polyamide or from synthetic or natural, hollow or solid materials, are distributed between two branches previously curved into a U shape. The plastically deformable wire is twisted in order to entrap the fibers in the form of bristles 8 distributed regularly along a helix. The ends of the bristles are evened out in the shape of an axisymmetric (cylindrical, conical, frustoconical, etc.) envelope by means of a cutting operation. In the example illustrated in FIG. 1, the outer envelope of the brush fibers is cylindrical with a circular cross section.

After operations of assembling and filling with mascara, the cap is screwed on to the bottle, and the bristles 8 are immersed in the mascara 20. At that moment, the brush 4 is heavily loaded with mascara. Removing it from the bottle makes the bristles 8 pass through the middle of the circular lip 6*a* of the wiper 6 which removes excess product.

In order to distribute the mascara in an advantageous manner over the brush, the method according to the present invention cuts off some bristles located in predetermined angular sectors along the twisted core. The cut reduced the length of the bristles, the bristles cut in this way are subsequently called short bristles. The ends of the short bristles are inscribed within an envelope of diameter "d" which is substantially equal to the diameter of the stem, and substantially equal to the diameter of the circular lip 6*a*, for example to within ±0.2 mm. Under these conditions, the mascara trapped between the bristles is not removed from the brush 4 when this brush passes through the lip 6*a* of the wiper 6.

As emerges from FIGS. 2*a* to 2*c*, the cut forms three, four or six alternating sectors of short bristles 9 and of uncut bristles 8, called long bristles, as opposed to short bristles. According to variants, the cutting can take place in a helical spiral having a pitch which is large with respect to the pitch of the twists, for example, five to ten times greater. The height H (FIG. 2*a*) of the short bristles corresponds to a radius measured from the center of the wire, that is to say to half the diameter "d" (FIG. 2*c*) of the envelope cross section of the short bristles 9. The long bristles 8 form a cylindrical envelope having a diameter "D" in cross section (FIG. 2*b*).

The sectors 10 (FIG. 2*c*) having long bristles 8 of angle $\alpha$ are evenly distributed about the core of the wire 7. These sectors are distributed alternately with the sectors 11 of short bristles 9, of angle $\beta$, also evenly distributed around the wire 7.

In the example illustrated in FIG. 2*c;*

$\alpha$=30°, $\beta$=30° envelope diameter "D" of the long bristles: 7 mm (5 to 8 mm in other examples)

envelope diameter "d" of the cut bristles: 3.8 mm;

envelope diameter of the twisted core: 1.5 mm.

Alternatively, the brushes have sectors which are not evenly distributed angularly, together with sectors having different angles for bristles of the same length.

One of the brushes according to one of FIGS. 2*a* to 2*c* is mounted on a stem 3 (FIG. 1) having a diameter equal to 4 mm, which corresponds substantially to that of the envelope of the short bristles. The opening diameter of the lip 6*a* of the wiper 6 is also equal to 4 mm. More generally, the opening diameter of the wiper is between about 2 and 6 mm, and the corresponding envelope diameter of the stem and of the short bristles is between 3 and 5 mm.

As the brush 4 passes through the lip 6*a*, the latter closes on the long bristles 8 of the sectors 10 which are wiped, while keeping a considerable amount of mascara in the sectors 11 provided with short bristles 9. The stem, the brush and the wiper form an applicator system according to the invention. In this assembly, the stem, the brush and the opening of the wiper have substantially identical dimensions of the envelope profile.

A brush according to the invention, as illustrated in the front and rear isometric views and in lateral section in FIGS. 3*a* to 3*c*, is presented under ideal conditions to ensure mascara is applied to the eyelashes. Specifically the brush 4 is provided with a large amount of mascara, while having long bristles 8 making it possible to brush, separate and possibly to curve the user's eyelashes. A uniform layer with a considerable thickness of mascara giving volume to the eyelashes is also applied by the short bristles 9.

The brush is trimmed in the sectors 11, with a shape which is initially conical from the end 12, then cylindrical. Similarly, the long bristles 8 have a conical shape at the end 12, so as to obtain a slender profile.

FIGS. 4 to 6 illustrate schematically three examples of cutting bristles of a mascara brush according to the present invention. A single fiber, corresponding to two diametrally opposed bristles 8, symbolically represents the brush. A grid or a plate 17 with a slot 19, for example a rectangular slot, selects the bristles 8 to be cut. To cut the bristles along a considerable length, the grid 17 is applied directly to the twisted wire 7 and the thickness of the grid 17 is small. This thickness corresponds substantially to the length of the cut bristles. A blade 21 moving alternately in the direction of the double arrow 23 cuts the bristle 8 by shearing between the cutting edge 25 of the blade 21 and the edge 27 of the slot 19. The grid 17 may have a thickness which varies depending on the desired cutting height, for example in order to obtain a conical cut at the brush end, as illustrated in FIGS. 3*a* to 3*c*.

In FIG. 5, the cutting device has two blades 21 and 21' placed substantially facing each other. These blades move one with respect to the other in the direction of the double arrows 23 and/or 23, chopping the bristles 8 by shearing them. The device of FIG. 5 may be fitted with guiding means (not shown), especially with respect to the twisted wire 7. The length of the bristle after cutting depends on the position of the blades 21 and 21', and on the thickness of the blade 21' placed nearest the twisted wire.

In FIG. 6, the bristles 8 are severed by a blade 21 applied to a first side of the bristle, the opposite side of which rests on a support or anvil 21". The blade 21-anvil 21" assembly may be brought closer to the twisted wire 7 in order to reduce the length of the bristle after cutting, or in contrast, be moved away there from in order to increase its length.

Annular, and especially circular, rotating blades other than linear blades moving with a flat alternating movement, as shown in FIGS. 4 to 6, may be implemented.

To obtain a meticulous cut, a hollow tube 29 made of treated Z38 steel is used in order to form a guiding module consisting of a head and of a tubular body for guiding the bristles. This tube is used in cooperation with cutting means, as illustrated in FIGS. 7 to 10 of a first embodiment.

The tube 29 has a central channel 31 for receiving the brush 4. The brush (not shown) is inserted through the inlet orifice 31*a* of the channel 31 in the direction of the arrow 33. The orifice 31*a* has a diameter less than the envelope diameter of the brush.

In the example illustrated, the tube 29 has as an end piece, after machining, the conical receiving head 29*a* extended by a cylindrical body 29*b*. The straight channel 31 extends over the entire length of the tube and corresponds substantially to its longitudinal axis 35. The channel 31 has longitudinal slots 37, only one of which is shown in FIG. 7, in order to select the bristles to be cut. The slots are obtained by wire electrical discharge machining.

In the example illustrated in FIGS. 8 to 10, the tube 29 has with a channel 31 comprising five longitudinal slots 37, evenly distributed angularly. These slots correspond to five cutting sectors provided with bristles having, after cutting, a shorter length. Each slot 37 opens out into a cutting region 39 on the surface of the tube 29*b* where a blade 41 severs the bristles which stick out. The tube 29*b* is provided with five cutting regions 39, each one associated with a cutting blade 41. The regions 39 are offset angularly with respect to each other and axially along the axis 35 (FIG. 10).

In the example illustrated, each region 39 is formed from a notch, of flat shape (FIG. 7) or slightly curved (FIG. 10), to which the blade 41, having a rectangular parallelepipedal shape, is matched. A V-shaped opening 43 with beveled slopes has been made in this flat section, the open side of the V being directed towards the opening of the channel inlet 31.

The channel 31 also has guiding grooves 45 located on the bisector of two consecutive slots 37. These grooves, of semicylindrical shape, form indentations 45*a* at the end of the channel 31. These indentations and the grooves provide fine, therefore improved, selection, and strict guiding of bristles protected from cutting. Since the distance between the bottom of the grooves and the axis of the channel 31 is less than the height of the bristles selected, these bristles are curved and no part projects out of the slot 37. This accurate selection of the bristles not to be cut causes accurate selection of the bristles to be cut.

In the example illustrated, an automatic means, such as a pusher with linear alternating movements (shown below), introduces the brushes into the channel 31 in the direction of the arrow 33. The bristles that it is desired to cut are positioned continuously and automatically in the slots 37 and poke out in the cutting regions 39. The movement of the brush with respect to the guiding device 29 ensures the bristles are cut in the V-shaped region 43 of the blade 41. Furthermore, the blade 41 may undego a sideways or vibratory movement in order to facilitate the cutting of the bristles. The blade may undergo a vibratory movement in the direction of the axis 35. Such a movement combined with a curved shape of the cutting slot makes it possible to cut with a variable and matched height.

The brush is then recovered at the exit from the channel 31, then is assembled onto a stem.

In the exemplary embodiment, the channel 31 is obtained by a central drilling having a diameter of 2 mm, from which extend semicylindrical grooves 45 having a diameter of 0.8 mm. The diameter of a circle passing through the outer ends of the grooves 45 extends radially to a distance of 2.8 mm. The slots 37 have a width of 0.4 mm and a height of 4 mm from the axis 35 passing through the center of the channel 31. The slots 37 open out into the cutting region 39 at a distance from the axis 35 of approximately between 1 and 2 mm.

According to another exemplary embodiment illustrated in FIG. 11, the slots 57 of the tube 49 are continuous from the guiding head to the body of the tube. The device 49 has a straight channel 51 for receiving the brushes, which are inserted through the inlet opening of the channel, as in the previous exemplary embodiment.

In the example illustrated, the tube 49 is provided, after machining, with a cylindro-conical head 49*a*, extended by a cylindrical body 49*b* having a smaller diameter. The channel 51 has six longitudinal slots 57 which select and orient the bristles to be cut. These slots are evenly distributed, forming six equal angular sectors for selecting the bristles to be cut. Each slot 57 has a width which decreases linearly over the conical part of the end piece 49*a*, then remains constant over the cylindrical parts of the head 49*a* and of the body 49*b* of the tube. A cutting region 59 is made on the surface of the device 49 where an annular blade 61 severs the bristles which pass through.

As illustrated in FIG. 12, a ring 60 is provided for centering the brushes on the tube axis. This ring is snap-fastened in the direction of the arrow 63. By suitable clamping, this ring also adjusts the width of the selecting slots in the conical region of the head 49*a*, so as to alter the width of the short bristle sectors.

In the exemplary embodiments illustrated in FIGS. 7 to 11, the height of the short bristles is located within a cylindrical envelope having a diameter equal to about 3 mm. As required, this diameter corresponds substantially to the diameter of the opening of the wiper. The channel 51 consists of a cylindrical bore having a diameter of 2.2 mm, in which the semicylindrical grooves 45 have a diameter of 0.4 mm and the slots 57 have a width of between 0.7 and 0.4 mm over the conical part of the head 49*a*. In the tubular part, the slots have a width of 50 mm.

As illustrated in FIGS. 13*a* to 13*c* of a second embodiment, the guiding module 69 shown in perspective views has a guiding head 69*a* with a bi-frustoconical end piece extended by a cylindrical part 69*b* followed by a tube body 69*c*, which is also cylindrical, but having a much smaller diameter. First cutting grooves 70, distributed longitudinally in the bore of the tube, select the brush bristles to be cut. Alternating with these first grooves, second guiding grooves 45 select the brush bristles to be left untouched, as in the first embodiment.

The first cutting grooves 70 are formed by parallel walls and a cylindrical bottom. These grooves are deep enough not to curve the bristles. These grooves 70 form indentations 70*a* on the end piece 69*a* and extend into the body of the tube 69*c* in order to form the cutting slots 57. The second guiding grooves 45 are semicylindrical, inscribed within an envelope having a diameter equal to 3 mm, so as to curve the selected bristles. These grooves also form indentations 45*a* on the end piece 69*a*.

The end piece 69*a* has a bi-frustoconical shape at the end, the outer truncated cone 69*e* converges toward the axis 35 of the tube when moving away from the tubular body 69*c*, while the inner truncated cone 69*i* diverges in this same direction. Under these conditions, the indentations 70*a* of the selecting and cutting grooves 70 are formed on the outer truncated cone, while the indentations 45*a* of the guiding grooves 45 are cut into the inner truncated cone. The body of the tube 69*c* is extended, away from the guiding head 69*a*, by a holding and rotationally driving end piece 69*d*.

As illustrated by the sectional and perspective views of FIGS. 14*a* and 14*b*, an annular centering ring 80 can be adapted to the guiding head 69*a* of FIGS. 13*a* to 13*c*. This ring makes it possible to improve the guiding by an effect of the "funnel" type.

An example of a cutting machine according to the invention is illustrated by the views in longitudinal section of FIGS. 15*a* and 15*b*.

The cutting machine 90 is equipped with a base 90*a* on which are set: a cutting tube such as the tube 69, a cutting blade such as the blade 41 mounted on the tube against the cutting slots, a driving pulley 91 for rotating the cutting tube at the speed of 20 000 rpm, the tube being mounted on roller bearings 92*a* and 92*b*. A thrust rod 93 successively brings, by an alternating movement, the brushes 4 into a centering tube 94 from a loading region 96. In this region, a loading trough 95 is provided.

Before entering the end piece 69*a*, the brush is made to rotate in a rotating tube 96 also mounted on the bearing 92*b*. A centering chuck 97 is also provided in order to couple the tube 69 to the drive pulley 91.

The present invention is not limited to the exemplary embodiments attached and shown. It is for example possible, after having carried out the trimming, to curve the twisted wire so as to obtain an improved application. Moreover, other trimming methods can be envisaged without departing from the scope of the present invention: for example, the regularly split conical or cylindrical guiding device undergoes an alternating or rotating movement while the cutting blades are fixed or also moveable.

Moreover, the blades may be formed by linear or circular cutting strips. Furthermore, the grooves may have different shapes: conical, cylindrical, V, etc.

The present invention is mainly, but not exclusively, applicable to the cosmetic industry.

The invention claimed is:

1. A method for cutting bristles of an applicator brush for a cosmetic product, comprising:

providing a brush having a core and bristles;

directing the brush into a guiding module, the guiding module including a selection head for selecting bristles to be cut and a tubular element defining at least one longitudinal slot, the at least one longitudinal slot configured to expose the bristles to be cut; and cutting the exposed bristles.

2. The method of claim 1, wherein the bristles are cut by one or more of a laser beam, a high-pressure water jet and ultrasound.

3. The method of claim 1, wherein all the bristles to be cut are cut simultaneously.

4. The method of claim 1, wherein the core is a twisted wire core.

5. The method of claim 1, wherein the bristles that are not cut are folded substantially parallel to the core.

6. The method of claim 1, wherein the guiding module has at least two longitudinal slots and the bristles exposed by the slots are not cut at the same time.

7. The method of claim 1, wherein the brush further includes a stem, attached to the core after cutting the bristles and wherein the bristles are cut to have a diameter that is substantially equal to the diameter of the stem.

8. The method of claim 1, wherein the brush has rows of long bristles along the core in the form of a helical spiral after the exposed bristles have been cut.

9. The method of claim 8, wherein the core is formed of twisted wires and the helical spiral of the long bristles has a pitch that is larger than the pitch of the twisted wires.

10. The method of claim 1, wherein the selection head includes cutting and guiding grooves.

11. The method of claim 1, wherein the guiding module includes a ring that can be used to adjust the width of the rows of the bristles to be cut.

12. The method of claim 1, wherein the guiding module includes notches around each longitudinal slot.

13. The method of claim 1, wherein the selection head includes an outer frustoconical end.

* * * * *